US006059610A

United States Patent [19]

Chu

[11] Patent Number: 6,059,610

[45] Date of Patent: May 9, 2000

[54] BOARD-TO-BOARD CONNECTOR HAVING RETENTION MECHANISM

[76] Inventor: Ho-Kang Chu, 17639 Antonio Ave., Cerritos, Calif. 90703

[21] Appl. No.: 09/255,025

[22] Filed: Feb. 22, 1999

[51] Int. Cl.[7] ..... H01R 24/00

[52] U.S. Cl. ..... 439/631; 439/67; 439/377

[58] Field of Search ..... 439/631, 632, 439/64, 377, 59

[56] References Cited

U.S. PATENT DOCUMENTS

| | | | |
|---|---|---|---|
| 3,482,201 | 12/1969 | Schneck | 439/631 |
| 3,801,953 | 4/1974 | Lynch | 439/377 |
| 3,932,016 | 1/1976 | Ammenheuser | 439/377 |
| 4,220,382 | 9/1980 | Ritchie et al. | 439/631 |
| 5,201,662 | 4/1993 | Roche | 439/377 |
| 5,393,234 | 2/1995 | Yamada et al. | 439/64 |
| 5,889,656 | 3/1999 | Yin | 439/337 |

*Primary Examiner*—Lincoln Donovan
*Assistant Examiner*—Hae Moon Hyeon

[57] ABSTRACT

An electrical connector includes a connection portion defining two channels in an insulative body thereof for respectively receiving and electrically engaging a main board and an external circuit board and a board support portion including two support bars having inner ends fixed to opposite sides of the insulative body thereby forming a U-shaped configuration for receiving the external circuit board in a space defined between the support bars. Each of the support bars has an inner surface from which two flanges extend thereby defining a groove for receiving and retaining an edge of the external circuit board. Each of the support bars defines a slot in the inner end between two side walls for receiving a sideways projection of the insulative body therein. Fasteners secure the sideways projections of the insulative body between the corresponding side walls of the support bars. Each sideways projection is provided with a section overlapping the main board and the fasteners secure the main board to the insulative body.

12 Claims, 2 Drawing Sheets

BOARD-TO-BOARD CONNECTOR HAVING RETENTION MECHANISM

BACKGROUND OF THE INVENTION

1. Field of the Invention

The present invention generally relates to an electrical connector, and in particular to a slot connector incorporating a circuit board support device therein for providing a better support to a circuit board connected to the connector.

2. The Prior Art

Conventionally, a central processing unit (CPU) is directly mounted to a main board of a computer. However, in order to more fully exploit the interior space of the computer, the CPU is often mounted to a circuit board to form a CPU module which is then connected to the main board by means of a connector. Such an arrangement, however, imposes a load on the connector due to the weight of the CPU module which may lead to an improper connection between the CPU module and the connector. If a heat dissipation device is added to the CPU module, the problem would become even more severe. Thus, it is important to ensure a proper connection between the CPU module and the connector.

SUMMARY OF THE INVENTION

Accordingly, an object of the present invention is to provide a connector comprising a board support device for securely retaining a circuit board or a CPU module thereon to ensure proper connection between the circuit board or the CPU module and the connector thereby providing a stable electrical engagement therebetween.

Another object of the present invention is to provide a connector comprising a support device to support the CPU module connected thereto for preventing the connector from being damaged or affected by the weight of the CPU module.

A further object of the present invention is to provide a connector comprising a device which prevents the electrical connection between the connector and the main board from being adversely affected when the CPU module is removed from the connector.

Yet another object of the present invention is to provide a connector having a device which securely fixes the connector to the main board.

Yet a further object of the present invention is to provide a connector having a device which guides the insertion of the CPU module into the connector.

To achieve the above objects, an electrical connector in accordance with the present invention comprises a connection portion defining two channels in an insulative body thereof for respectively receiving and electrically engaging a main board and an external circuit board and a board support portion comprising two support bars having inner ends fixed to opposite sides of the insulative body thereby forming a U-shaped configuration for receiving the external circuit board in a space defined between the support bars. Each of the support bars has an inner surface from which two flanges extend thereby defining a groove for receiving and retaining an edge of the external circuit board. Each of the support bars defines a slot in the inner end between two side walls for receiving a sideways projection of the insulative body therein. Fasteners secure the sideways projections of the insulative body between corresponding side walls of the support bars. Each sideways projection is provided with a section overlapping the main board and the fasteners secure the main board to the insulative body.

In accordance with an aspect of the present invention, one of the flanges of each support arm defines a cutout in an end thereof for facilitating insertion/withdrawal of the edge of the external circuit board into/out of the groove of the support portion.

In accordance with another aspect of the present invention, the support bars may be provided with securing means, such as an opening defined in the support bar or a slit defined between one of the flanges and the inner surface of the support bar each engaging with a corresponding protrusion formed on the external circuit board for securing the external circuit board to the support bars.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
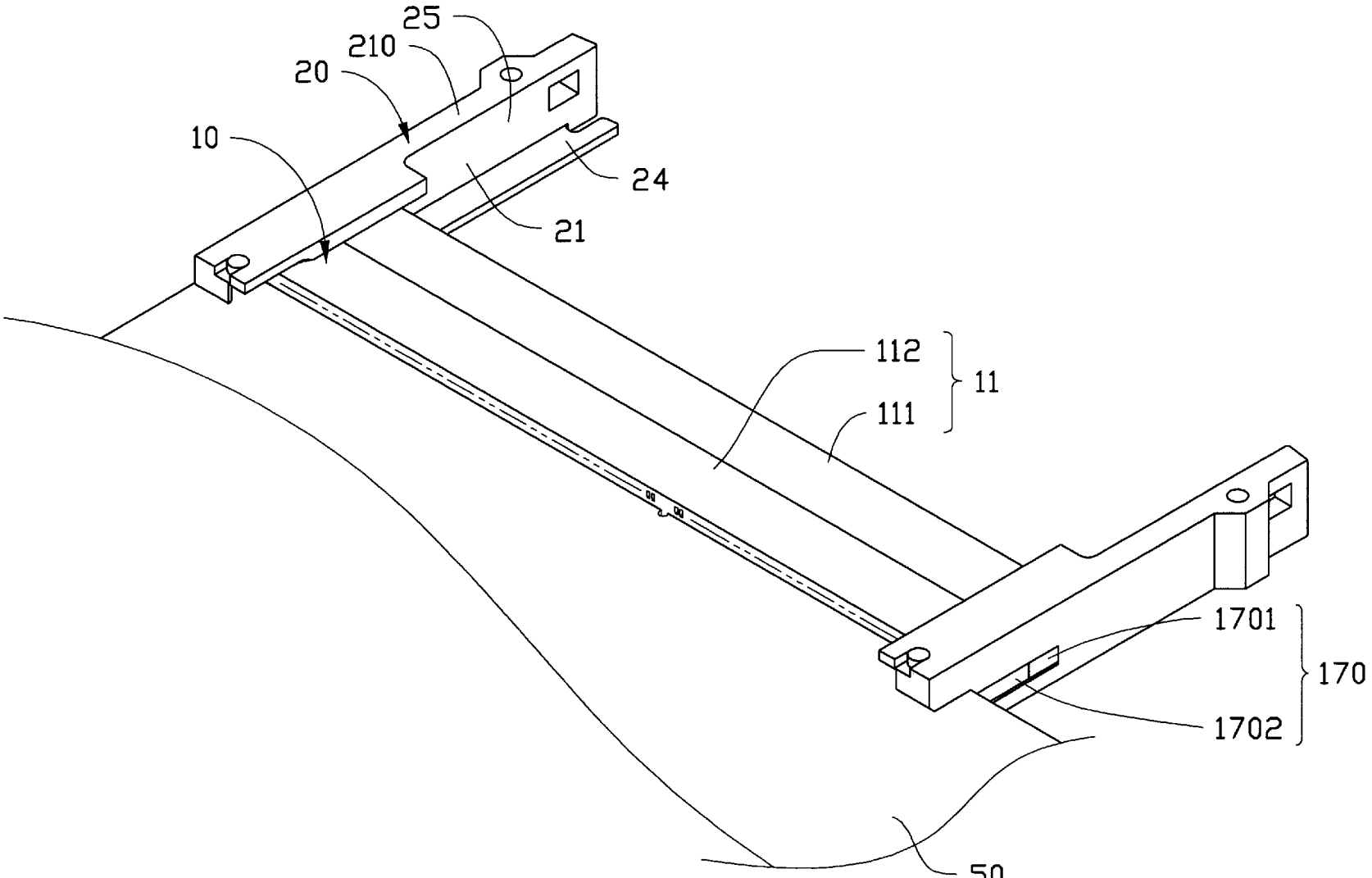
FIG. 1 is a perspective view of an electrical connector in accordance with the present invention mounted on a main board.
Figure 2:
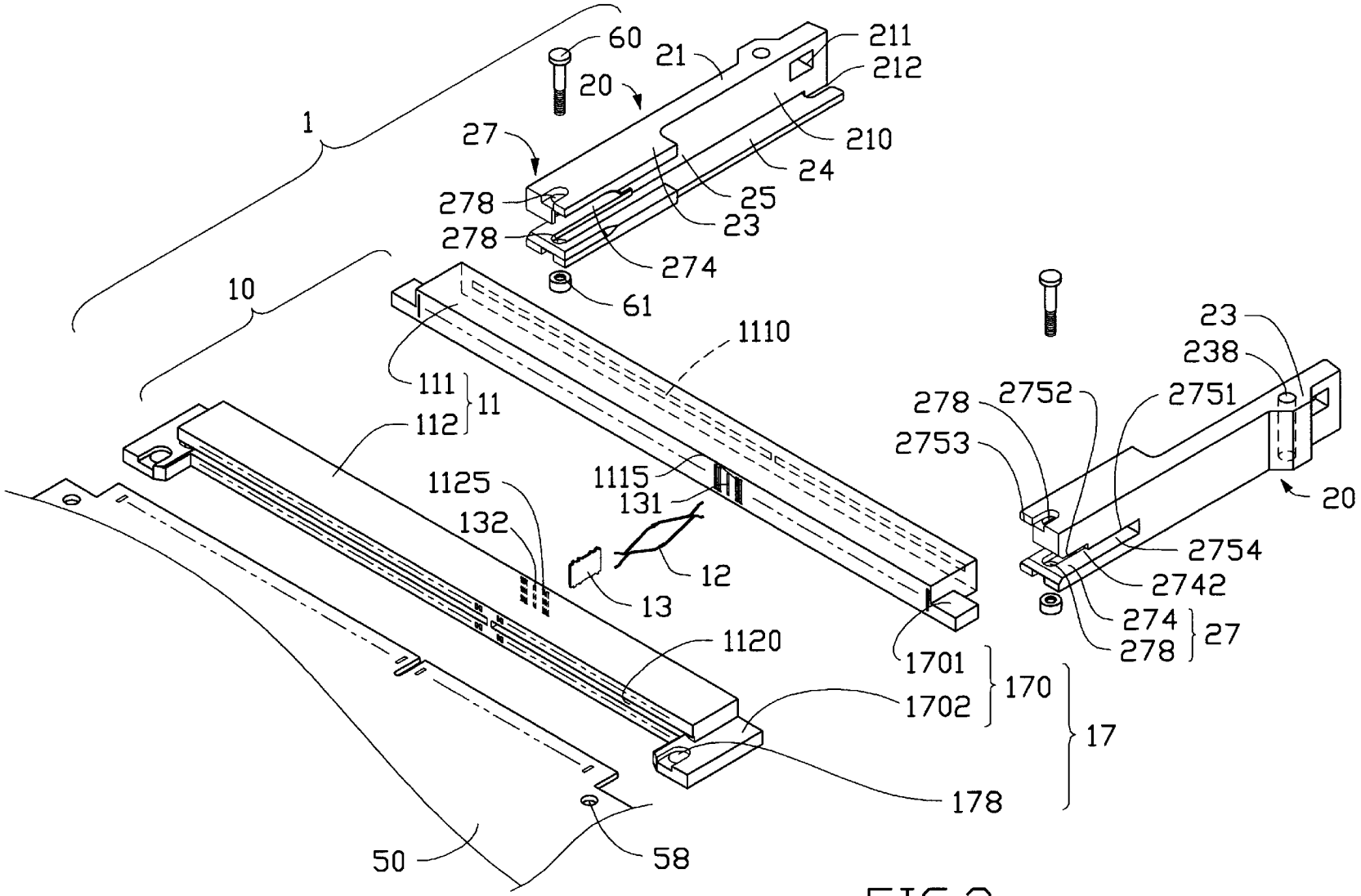
FIG. 2 is an exploded perspective view of FIG. 1.

Referring to FIGS. 1 and 2, an electrical connector 1 comprises a connection portion 10 and a board support portion 20. The connection portion 10 comprises an insulative body 11 having a first insulation member 111 and a second insulation member 112. Each insulation member 111, 112 defines a receiving channel 1110, 1120 therein, opposite to and substantially aligned with each other. A plurality of contact receiving passageways 1115, 1125 are defined in each insulation member 111, 112 in communication with the channels 1110, 1120 whereby the passageways 1115, 1125 are aligned with each other for retaining a contact terminal 12 therein whereby each contact terminal 12 extends through the corresponding passageway 1115, 1125. The receiving channels 1120, 1110 retain a main board 50 and an external circuit board, such as a CPU module (not shown), therein to establish electrical connection therebetween via the contact terminals 12.

The insulative body 11 comprises at least one press-fitting plate 13 having two ends fit into corresponding slits 131, 132 defined in the insulation members 111, 112. However, the engagement between the press-fitting plate 13 and the insulation members 111, 112 is not sufficient to hold the two insulation members 111, 112 together when the main board 50 and/or the external circuit board is removed from the connector 1. To overcome such a problem, retention means is provided to more securely retain the two insulation members 111, 112 together.

The board support portion 20 comprises two support bars 21 each having an inner end mounted to opposite ends of the insulative body 11 thereby defining a U-shaped structure for receiving the external circuit board in a space defined between the support bars 21. Each of the support bars 21 forms a pair of flanges 23, 24 extending from an inner surface 210 thereof thereby defining a groove 25 for guiding lateral edges of the external circuit board. To facilitate insertion/withdrawal of the lateral edges of the external circuit board into/out of the corresponding grooves 25, the flange 23 is shorter than the flange 24 thereby defining an end cutout (not labeled) in the flange 23 through which the lateral edge of the external circuit board may be easily inserted into/withdrawn from the grooves 25.

Each support bar 21 defines an opening 211 through an outer end thereof and/or a slit 212 between the inner surface 210 and the flange 24 and exposed to a free end of the support bar 21. The opening 211 and the slit 212 engage with corresponding projections formed on the external circuit board for more securely retaining the external circuit board between the support bars 21.

The retention means comprises a first means 27 and a mating second means 17. The first means 27 comprises a slot 274 defined in the inner end of each support bar 21 between two side walls 2754, 2751.

The second means 17 comprises a projection 170 formed on each end of the insulative body 11 for being received in the slot 274 of the corresponding first means 27. The projection 170 comprises a first section 1701 formed on each end of the first insulation member 111 and a second section 1702 formed on each end of the second insulation member 112. Both the first and second sections 1701, 1702 are formed to be received in the corresponding slot 274 and thus retained between the side walls 2754, 2751.

The second section 1702 of the projection 170 defines a hole 178 for aligning with holes 278 defined in the side walls 2754, 2751 whereby a bolt 60 is extended therethrough for engaging with a nut 61 thereby securing the support bars 21 to the insulative body 11.

The second section 1702 is formed to be partially overlapped by the main board 50. A hole 178 defined in the second section 1702 aligns with a hole 58 defined in the main board 50 whereby the bolt 60 for securing the support bar 21 to the insulative body 11 extends therethrough to secure the main board 50 to the insulative body 11. To accommodate the overlapping portion of the main board 50, the side wall 2751 of the support bar 21 forms a recessed section 2752.

In the embodiment illustrated, the first and second sections 1701 1702 of the projection 170 of the insulative body 11 have a thickness smaller than that of the respective insulation members 111, 112 whereby a step-like configuration is formed on the ends of each of the insulation members 111, 112. To accommodate the step-like configuration, each slot 274 is provided with a further recessed section 2753 for receiving end portions of the insulation members 111, 112.

Such an arrangement securely fixes the connection portion 10, the board support portion 20 and the main board 50 together and thus the engagement between the first and second insulation members 111, 112 and the engagement between the connection portion 10 and the main board 50 will not be adversely affected during the removal/insertion of the external circuit board out of/into the connector 1.

If desired, each of the support bars 21 may further define a hole 238, which allows the support bar 21 to be additionally fixed to another fixed member by means of a bolt (not shown).

It has been demonstrated that a bolt 60 can secure each of the support bars 21 to the connection portion 10. However, the bolt 60 may be replaced by a pivot pin to allow the support bar 21 to be rotatable with respect to the connection portion 10. In this case, a bolt extending through the hole 238 can fix the support bar 21 in position for securely retaining the external circuit board between the two support bars 21.

One feature of the invention is to provide the pair of independent support bars of the board support portion for holding the connection portion therein. The independence and separateness of these two support bars not only saves space during shipping and handling, but also provides capability of adjustment when the support bars are secured to the aforementioned another fixed member at one end and combined with the connection portion and the main board at the other opposite end.

Although the present invention has been described with reference to a preferred embodiment, it is apparent to those skilled in the art that a variety of modifications and changes may be made without departing from the scope of the present invention which is intended to be defined by the appended claims.

What is claimed is:

1. An electrical connector comprising:

a connection portion comprising an insulative body defining a first channel and an opposite second channel therein, each channel accommodating a contact terminal therein and adapted to respectively receive a main board and an external circuit board whereby electrical connection is established therebetween; and a board support portion comprising two support bars, each support bar having an inner end on which retention means is provided to secure the support bar to a corresponding end of the connection portion whereby the support bars receive the external circuit board therebetween, each of the support bars having an inner surface from which a first flange and a second flange extend to define a groove for receiving and retaining an edge of the external circuit board therein, wherein the retention means comprises a slot defined between two side walls formed on the inner end of each of the support bars and a sideways projection formed on each end of the insulative body of the connection portion, the projection being received in the slot, a fastener being provided to secure the projection between the side walls; and at least one of the side walls defines a recessed section in an inner surface thereof to accommodate a portion of the insulative body.

2. The electrical connector as claimed in claim 1, wherein the insulative body comprises a first member and a second member secured together and wherein the first and second channels of the insulative body are respectively defined in the first and second members.

3. The electrical connector as claimed in claim 2, wherein the first channel of the first member is opposite to and communicates with the second channel of the second member whereby the contact terminals extend through both channels.

4. The electrical connector as claimed in claim 3, wherein the projection of the insulative body comprises a first section formed on the first member and a second section formed on the second member, each section being received in the corresponding slot and retained between the two side walls.

5. The electrical connector as claimed in claim 4, wherein the second section of the projection defines a first hole and the side walls define second holes corresponding to the first hole of the second section and wherein the fastener comprises a bolt extending through the first hole of the second section and the second holes of the side walls for engaging with a nut thereby securing the support bar to the insulative body.

6. The electrical connector as claimed in claim 1, wherein the sideways projection of the insulative body has a portion overlapped by the main board and wherein the fastener that secures the projection to the side walls of the support bar also secures the main board to the sideways projection.

7. The electrical connector as claimed in claim 6, wherein one of the side walls defines a recessed section in an inner surface thereof to accommodate a portion of the main board received in the slot.

8. The electrical connector as claimed in claim 1, wherein the first flange defines a cutout in an end thereof for facilitating reception of the corresponding edge of the external circuit board into the grooves of the support bars.

9. The electrical connector as claimed in claim 1, wherein each of the support bars defines an opening therein, adapted to engage with a corresponding projection formed on the external circuit board thereby securing the external circuit board to the support bar.

10. The electrical connector as claimed in claim 1, wherein one of the flanges defines a slit between the flange and the inner surface of the support bar adapted to engage a corresponding projection formed on the external circuit board thereby securing the external circuit board to the support bar.

11. An electrical connector comprising:

a connection portion comprising an insulative body defining a first channel and an opposite second channel therein, each channel accommodating a contact terminal therein and adapted to respectively receive a main board and an external circuit board whereby electrical connection is established therebetween; and a board support portion comprising two support bars, each support bar having an inner end on which retention means is provided to secure the support bar to a corresponding end of the connection portion whereby the support bars receive the external circuit board therebetween, each of the support bars having an inner surface from which a first flange and a second flange extend to define a groove for receiving and retaining an edge of the external circuit board therein, wherein the retention means comprises a slot defined between two side walls formed on the inner end of each of the support bars and a sideways projection formed on each end of the insulative body of the connection portion, the projection being received in the slot, a fastener being provided to secure the projection between the side walls; and the sideways projection of the insulative body has a portion overlapped by the main board and wherein the fastener that secures the projection to the side walls of the support bar also secures the main board to the sideways projection.

12. An electrical connector comprising:

a connection portion comprising an insulative body defining a first channel and an opposite second channel therein, each channel accommodating a contact terminal therein and adapted to respectively receive a main board and an external circuit board whereby electrical connection is established therebetween; and a board support portion comprising two support bars, each support bar having an inner end on which retention means is provided to secure the support bar to a corresponding end of the connection portion whereby the support bars receive the external circuit board therebetween, each of the support bars having an inner surface from which a first flange and a second flange extend to define a groove for receiving and retaining an edge of the external circuit board therein, wherein one of the flanges defines a slit between the flange and the inner surface of the support bar adapted to engage a corresponding projection formed on the external circuit board thereby securing the external circuit board to the support bar.

* * * * *